US005921759A

United States Patent [19]

Khan

[11] Patent Number: 5,921,759

[45] Date of Patent: Jul. 13, 1999

[54] LIQUID METERING PISTON PUMP AND VALVES CAPABLE OF BEING CLEANED AND STERILIZED WITHOUT DISASSEMBLY

[75] Inventor: Sandeep Khan, 16 Banor Dr., Somerville, N.J. 08876

[73] Assignee: Sandeep Khan, Somerville, N.J.

[21] Appl. No.: 08/950,044

[22] Filed: Oct. 14, 1997

[51] Int. Cl.[6] ..... F04B 19/02

[52] U.S. Cl. ..... 417/460; 417/546; 417/547; 137/238; 137/240; 137/241

[58] Field of Search ..... 417/460, 546, 417/547; 137/238, 240, 241

[56] References Cited

U.S. PATENT DOCUMENTS

| | | | |
|---|---|---|---|
| 2,543,280 | 2/1951 | Everett | 141/176 |
| 2,795,196 | 6/1957 | Moskowitz | 103/153 |
| 2,801,650 | 8/1957 | Breeback | 141/169 |
| 3,058,276 | 10/1962 | Palma | 141/92 |
| 3,228,570 | 1/1966 | Steinman | 222/321 |
| 3,729,032 | 4/1973 | Tischlinger et al. | 141/2 |
| 4,000,765 | 1/1977 | Lydiksen | 141/181 |
| 4,363,338 | 12/1982 | Brown | 141/1 |
| 4,401,141 | 8/1983 | Rosen et al. | 141/192 |
| 4,489,769 | 12/1984 | Catelli | 141/91 |
| 4,570,822 | 2/1986 | Brocacino | 222/14 |
| 4,630,654 | 12/1986 | Kennedy, Jr. | 141/83 |
| 4,635,688 | 1/1987 | Graffin | 141/1 |
| 4,651,788 | 3/1987 | Grosskreuz et al. | 141/83 |
| 4,667,709 | 5/1987 | Fischer et al. | 141/91 |
| 4,676,282 | 6/1987 | Bellini et al. | 141/1 |
| 4,688,611 | 8/1987 | Yoshida | 141/91 |
| 4,711,264 | 12/1987 | Medvid | 137/241 |
| 4,832,092 | 5/1989 | Hirose et al. | 141/1 |
| 5,031,673 | 7/1991 | Clussevrath | 141/92 |
| 5,067,531 | 11/1991 | Herzog | 141/177 |
| 5,156,193 | 10/1992 | Carufato | 141/1 |

FOREIGN PATENT DOCUMENTS

| | | | |
|---|---|---|---|
| 1402 | 9/1889 | Italy | 417/460 |

*Primary Examiner*—Timothy S. Thorpe
*Assistant Examiner*—Ehud Gartenberg

[57] ABSTRACT

An inverted, displacer type piston pump for metering and dispensing liquids in which the cylinder is located beneath the piston and reciprocated via an actuator below the cylinder, and where the piston is held fixed. The liquid ingress and egress to and from the cylinder of the pump is via a cylindrical port through the piston along its cylindrical axis. The pump is designed so that liquid product loss through the pump is prevented without the use of elastomeric or compliant seals in the liquid contact product areas of the pump. In addition, the pump cylinder is capable of being positioned via its reciprocating actuator such that all of the liquid product contact parts are open and accessible to cleaning and sterilizing fluids which may be introduced into the pump through the liquid product supply port of the pump, thereby enabling cleaning and sterilization of the pump without its disassembly. Several embodiments of externally mounted externally operated poppet type valves designed to work in conjunction with the aforesaid or similar pumps are also indicated in which because of no sliding contact between the valve components, there is very little valve wear and a consequently a lower risk of product contamination from particulates. In addition all of the embodiments of the valves permit cleaning and sterilization of liquid product contact surfaces through the use of the aforementioned cleaning and sterilizing agents, without disassembly of the valves. Further, one embodiment of the valve also has a 'suck back' feature within it, so that when the valve shifts from its open to its closed position, a small amount of the liquid product contained in the nozzle and discharge line is pulled back into the valve.

1 Claim, 9 Drawing Sheets

SECTION I–I

SECTION I–I

SECTION I–I

SECTION I–I

LIQUID METERING PISTON PUMP AND VALVES CAPABLE OF BEING CLEANED AND STERILIZED WITHOUT DISASSEMBLY

Liquid metering piston pump and valves capable of being cleaned and sterilized without disassembly.

BACKGROUND OF THE INVENTION

This invention relates to a high precision liquid metering piston pump and externally mounted and actuated valves for accurate dispensing of liquids and that is capable of being cleaned and sterilized without disassembly, through the use of water, cleaning and sanitizing solutions, and steam. Such a liquid metering and dispensing system offers significant advantages in the automatic aseptic filling of pharmaceutical and other liquid products that must be filled into containers in an aseptic and contamination free environment.

Piston pumps for metering and dispensing liquid products are in common use, and offer a reliable and precise means of metering and delivering a wide variety of liquids. However, in most cases the designs are such that they cannot be cleaned, decontaminated and sterilized without first dismantling them into their constituent parts. Their subsequent assembly after cleaning and sterilization (where applicable), imposes a risk of recontamination of the devices from human and environmental factors.

The invention described herein, provides the benefits of precision, versatility and reliability of other piston pumps and their valves, while overcoming the disadvantages related to their need to be dismantled for cleaning, decontamination and sterilization. The invention also overcomes certain problems associated with piston pumps and valves that can be cleaned and sterilized without disassembly as they exist in prior art.

In the prior art designs of such types of devices, the piston is reciprocated and the cylinder is held stationary. Ingress and egress of the liquid product is through a port within the cylinder. In equipment that utilize these devices, the pumps are mounted vertically and the reciprocating actuators for the pistons are located beneath the pumps. This configuration allows the equipment to conform to the regulations relating to "Current Good Manufacturing Practices" of the Food and Drug Administration (FDA) and permits their use for metering and pumping liquids under clean and aseptic conditions, liquids such as parenteral drugs and certain food products. In such an arrangement however, the guide/seal area between the piston and cylinder is located beneath the cylinder cavity.

This presents a formidable challenge in both the design as well as the high tolerance fabrication of these pumps; particularly in the seal/guide region, where diametrically conflicting requirements need to be resolved. Since no elastomeric or other compliant seals can be used in this region (due to its inability to assure cleaning and sterilization in place), a tight clearance between the moving piston and stationary cylinder is required to minimize liquid product leakage. However too tight a clearance impedes hydrodynamic lubrication of the surfaces and can result in binding of the piston. This is especially exacerbated when pumping viscous liquids, suspensions or near saturated solutions.

This intractable problem is presently addressed by either tolerating a certain leakage loss of the liquid product through the seal/guide region or by using tighter clearances and separately and externally lubricating the piston with clean water. Neither of these solutions appear very desirable. In the former case, many liquid drugs are extremely expensive and often toxic. Their loss through leakage can be monetarily significant, as well as have the potential of exposing operators to toxic substances. The latter solution on the other hand can cause product contamination and cannot therefore be used with many kinds of products.

Among the valves used in such prior art designs, a popular type is the rotary spool valve usually mounted directly above the cylinder. These valves are also designed and fabricated to work without the use of elastomeric or other compliant seals. Actuation of the valve during pump operation is rotary. However, to set up for cleaning and sterilization, the valve spool is shifted longitudinally (along its axis) to expose the liquid contact areas, particularly in the seal regions. Separate actuators are required to shift this spool, adding to the cost and complexity of the system. In addition, the rotary sliding motion of the valves causes wear and sheds particles which enter the product stream.

Another type of valve used with these pumps is one in which a flexible diaphragm is used to isolate the liquid product contact area from the valve actuation device. In these designs, the flexible diaphragm has a limited life which is shortened with exposure to pressurized steam. This is particularly true with elastomeric diaphragms. Less so with metal diaphragms. As a result, such valves are subject to sudden and unpredictable failures. Worse, undetected pin holes develop in the diaphragm which can lead to loss of sterility of the product as well as its contamination.

Various liquid metering systems are presently available that are used for dispensing sterile pharmaceutical liquids and that can be cleaned without disassembly. Cleaning the metering systems without disassembly offers some advantages in the maintaining of sterility of the liquid drugs dispensed, in that a potential contamination hazard due to disassembly, cleaning and sterilization and subsequent reassembly of the pump systems (liquid product contact parts) is eliminated.

Of the various liquid metering and dispensing systems available for this purpose, those utilizing piston pumps and mechanical or electro-mechanically operated valves, tend to be the most accurate and reliable. There do exist piston pump and valve systems capable of being cleaned and sterilized without disassembly, in prior art; notably U.S. Pat. Nos. 4,688,611, and No. 4,832,092 assigned to Shibuya Kogyo. Also, U.S. Pat. No. 4,638,925 assigned to Robert Bosch GMBH.

SUMMARY OF THE INVENTION

This invention consists of the following:

A piston pump without any elastomeric seals between piston and cylinder, and consisting of a reciprocating cylinder and a stationary piston; as opposed to a stationary cylinder and a reciprocating piston as is normally the case. Except for the piston guide and seal area, a substantial clearance is maintained between the piston and the internal wall of the cylinder; the pump relying on the fact of incompressibility of liquids. In effect it is a displacer piston and cylinder combination.

The piston itself is provided with a hollow cylindrical core through which the liquid product is brought into the displaced cavity within the cylinder, and pushed out again through the reciprocating action of the cylinder. This arrangement permits the mechanisms for reciprocating actuation to be positioned at the bottom of the filling machine and below the pumps. This is the desired location for the actuation devices to minimize particulate generation and conform to the regulations of the Food and Drug Administrations for manufacture of various foods and aseptic drugs.

At the same time it permits the cylinder-piston guide and seal area to be positioned directly above the displaced volume within the cylinder. The liquid product itself is utilized for hydrodynamic lubrication of the seal/guide area, and the flow of liquid product through this area, instead of leading out of the system, flows directly back into the cavity displaced within the cylinder, due to the effects of gravity and suction pressure. The intractable problem of providing enough seal clearance so as not to cause binding between piston and cylinder, and yet not so much as to cause product leakage through the seal is thereby negated. Indeed a fairly generous seal clearance can now be provided without causing liquid loss.

The piston and cylinder in this invention, is also designed so that is has two positions: a) an operating or pumping position and b) a cleaning and sterilization position. Prior to cleaning and sterilization of the system, the reciprocating actuator mechanism drives the cylinder to seat against a seal ring at the top. This opens up all of the liquid product contact parts to the open access of cleaning agents and pressurized steam.

External valves are also embodied as part of this invention, that work in conjunction with the piston-cylinder arrangement described. The valves are externally operated and of the poppet type, which suffers from little wear and hence very low contamination of the liquid product flowing through it due to particulates. In addition, one of the valve embodiments is also designed so that it has two positions; an operating position and a cleaning and sterilizing position. In this position, all of the liquid product contact parts, including those in the seal area, are made accessible to cleaning agents and pressurized steam. The valve actuator serves the dual purpose of normal on-off valve operation, as well as positioning the valve spool for cleaning and sterilization.

Other embodiments of the valves do not have a penetration through the valve body that requires sealing against product leakage, and hence do not require any special provisions to make all of its liquid product contact parts, accessible to cleaning solutions and steam.

The arrangement described above offers several advantages to designs existing in prior art. Namely:

a) In aseptic environments, it is particularly critical to avoid 'dead legs' in the liquid product path, where liquid accumulates and does not drain via gravity. For this reason, aseptic liquid dispensing pumps, are mounted with their longitudinal axis vertical, and with the reciprocating drive actuators enclosed beneath. Elastomeric seals such as cartridge seals or 'O' rings, are often employed to prevent liquid leakage through the seal/guide area of the piston and cylinder. However, the use of such seals precludes effective cleaning and sterilization within these areas without disassembly. The piston/cylinder arrangement embodied in this invention does not require any elastomeric seals in the seal/guide area. In fact, it requires a small clearance between piston and cylinder to permit smooth operation, through hydrodynamic lubrication. The resulting leakage of liquid through this area, instead of leaking out of the system, feeds directly back into the system through the force of gravity as well as the suction pressure imposed by the cylinder in its downward stroke.

This permits a fairly generous clearance in the seal/guide region without liquid loss, which in turn permits liquids with a wide variety of physical characteristics, such as saturated solutions, emulsions or liquids of high visco-elasticity, to be accurately and reliably pumped.

b) The device is compact and the reasonably generous seal clearance also reduces fabrication costs of this device.

c) The design also permits the actuators used for operating the cylinder as well as valve spools, to serve as positioning devices for in place cleaning and sterilization. Additional actuators for this purpose are unnecessary.

d) The combination of piston pump and valves described herein, permit them to be fabricated from various wear and corrosion resistant materials, such as ceramics and various types of alloys or stainless steels.

DESCRIPTION OF THE PREFERRED EMBODIMENTS

Figure 1:
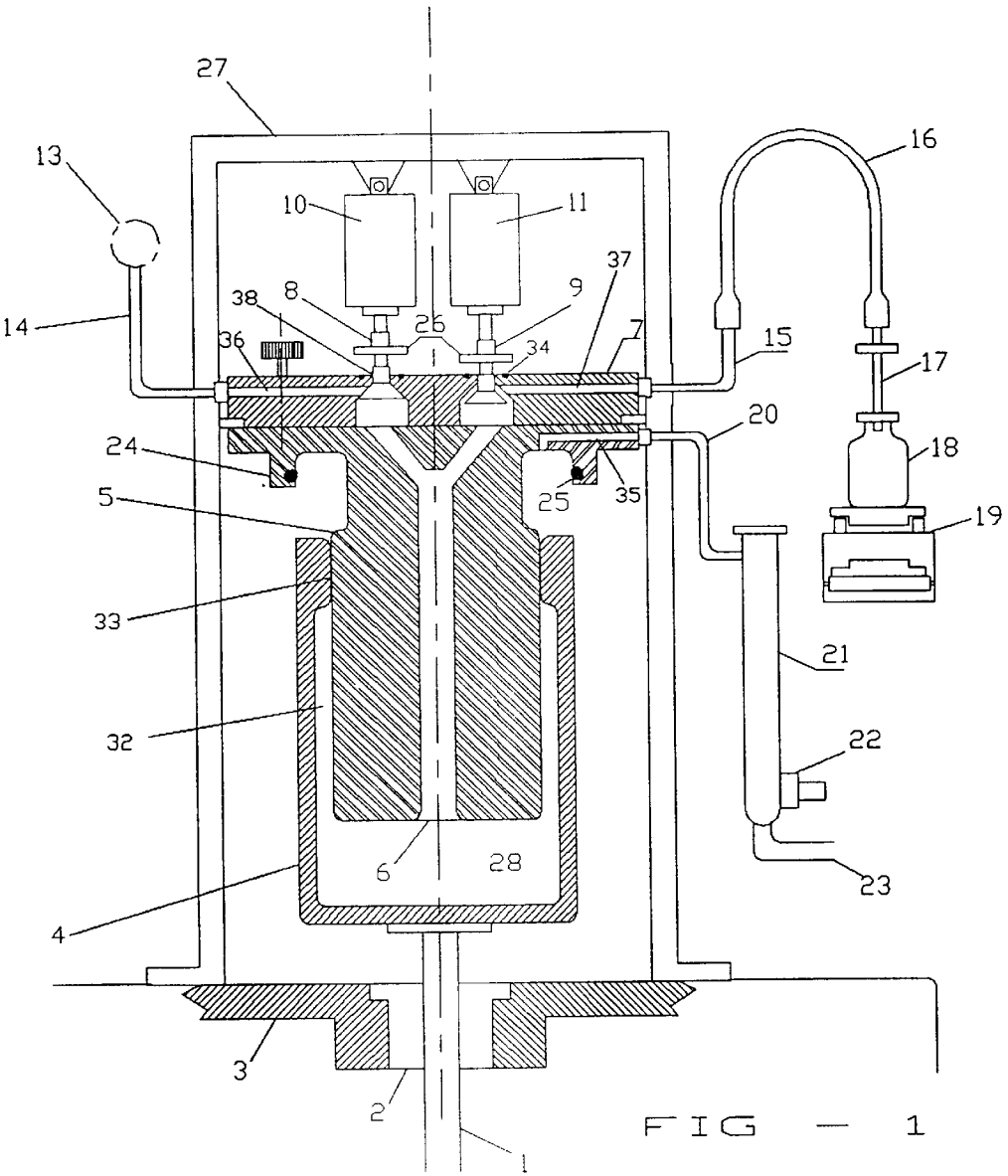
FIG. 1 indicates a sectional view of the general arrangement of the liquid metering pump and valve along with the cleaning and sterilizing system as mounted on a machine. The container to be filled along with the filling nozzle are also indicated and the unit is in the product filling mode.

A preferred embodiment of the piston and cylinder of the liquid metering pump is indicated in the attached drawing FIG. 1, in which the cylinder is reciprocated and the piston is held fixed;

in which a cylindrical cavity exists within the center line core of the cylinder which bifurcates at the top of the piston and through which the liquid product flows both in and out of the cavity displaced by the pump and reciprocating cylinder;

in which the upper part of the piston and integral with it is a seal ring with an 'O' ring that the product does not contact and against which the cylinder may be seated and sealed for cleaning, decontamination and sterilization of the liquid product contact surfaces which are thereby exposed, by running cleaning solutions and steam through the system;

in which the upper part of the piston and integral with it also forms the attachment surface of a valve block, or alternatively, a transfer tube;

and in which is provided an internal passage within the top of the piston for the passage and discharge of cleaning agents and steam during the cleaning and sterilization cycle.

Figure 5:
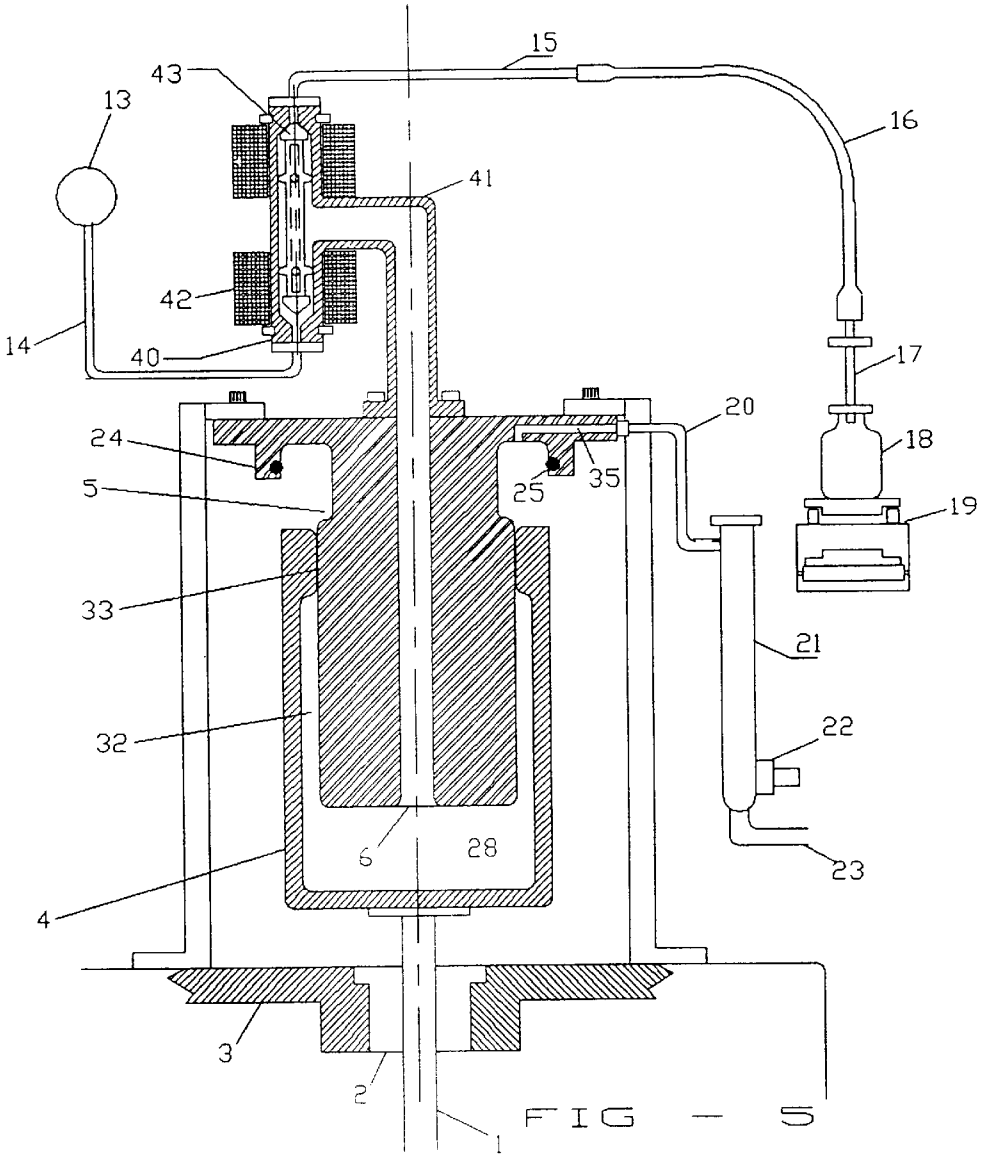
FIG. 5 is a sectional view of the same general arrangement of the pump, but with a different valve embodiment possessing a magnetically operated valve spool.

Another preferred embodiment of the piston and cylinder arrangement of the piston pump is indicated in the attached drawing FIG. 5, in which the cylindrical cavity through the center line of the piston does not bifurcate at the top.

Figure 4B:
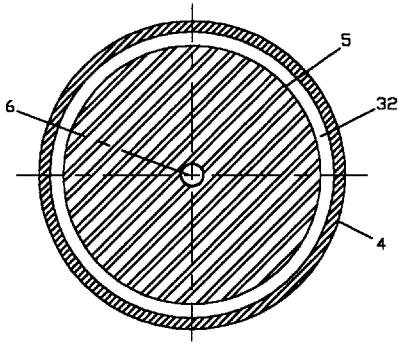
FIG. 4B is a sectional view across section I—I of FIG. 4A.

Another preferred embodiment of the piston pump (piston and cylinder arrangement), is indicated in the attached drawing FIG. 4, in which a groove is machined into the peripheral surface of the piston to improve lubrication of the seal/guide area of the cylinder with the liquid product, especially for certain types of liquids;

and in which the upper nearly horizontal surface of the cylinder is sloped towards the piston center line to permit the accumulation of an annular pool of liquid product.

Figure 3:
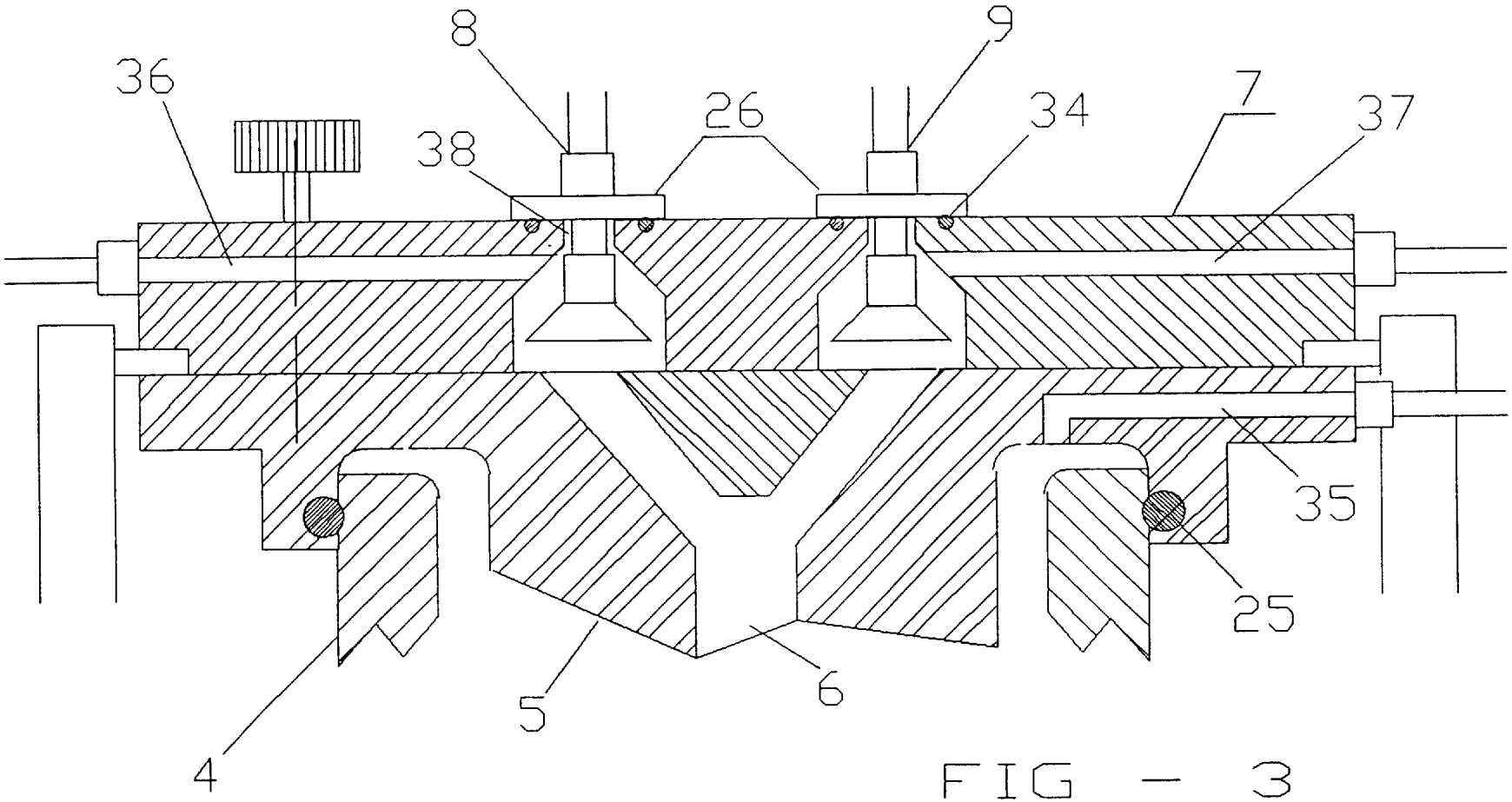
FIG. 3 is an enlarged sectional view of the valve block and pump head, indicating the flow path of the cleaning liquid and steam for sterilization. It indicates how product contact areas are all exposed to these cleaning and sterilizing agents.

A preferred embodiment of the externally mounted and externally actuated poppet valve is indicated in the attached drawings FIG. 1 and FIG. 3, in which a single valve block accommodates both intake and discharge valve and is affixed directly to the top of the piston;

in which are two identical but independently actuated poppet valves;

in which the poppets can be positioned via actuators to seal against "O" rings on the top surface of the valve block where they do not come in contact with the liquid product, thereby exposing the seal/guide area of the valve spools to become exposed to cleaning agents and steam which may be used to clean and sterilize the valves without disassembly;

and in which the liquid inlet and discharge passages are located within the valve block, and the valve block is affixed to the machine frame and supports the piston.

Figure 6B:
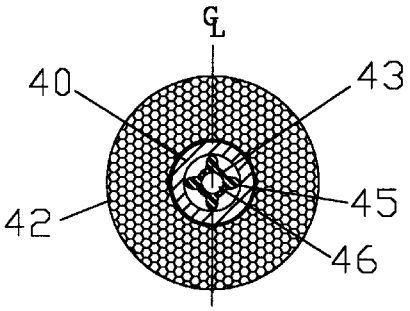
FIG. 6B is a sectional view across section I—I of FIG. 6A.
Figure 6A:
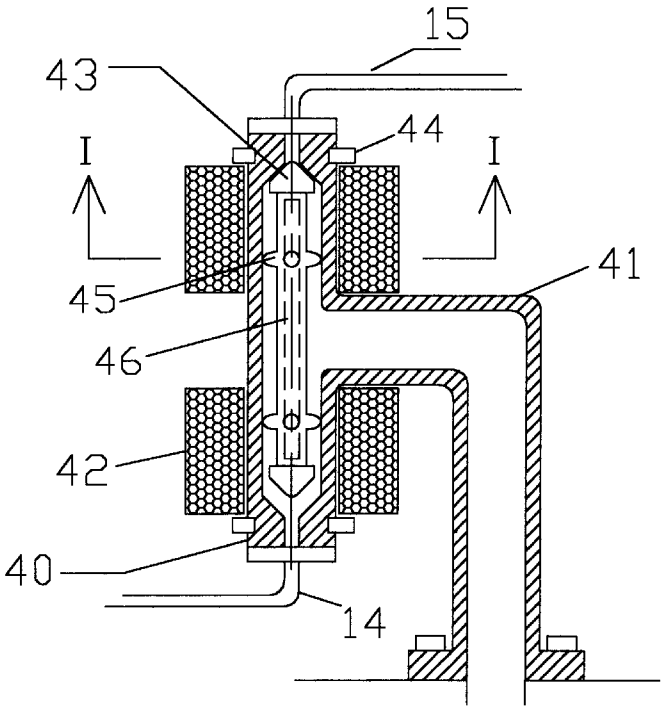
FIG. 6A is an enlarged sectional view of the magnetically coupled valve spool and valve body as indicated in FIG. 5.

Another preferred embodiment of the valve is indicated in the attached drawings FIG. 5 and FIG. 6A. in which a single valve with a double ended spool serves the dual function of liquid inlet and discharge valves;

in which the sealing surfaces are tapered seals and there are three liquid transfer ports;

in which there are no penetrations of the valve body to accommodate any device to couple with and operate the valve spool and which would then necessarily come into contact with the liquid and require sealing, and also subsequent cleaning sterilization;

in which the valve spool is coupled to its actuator through magnetic force and requires no special positioning to enable exposure of all liquid product contact parts to cleaning agents and steam, so that cleaning and de-contamination without disassembly becomes possible, in which an electro-magnetic coil to provide the necessary magnetic force may be mounted directly over the valve body;

and in which a magnetic material may be inserted into the core of the valve spool in those instances where the spool itself is made of a non magnetic material.

Figure 7:
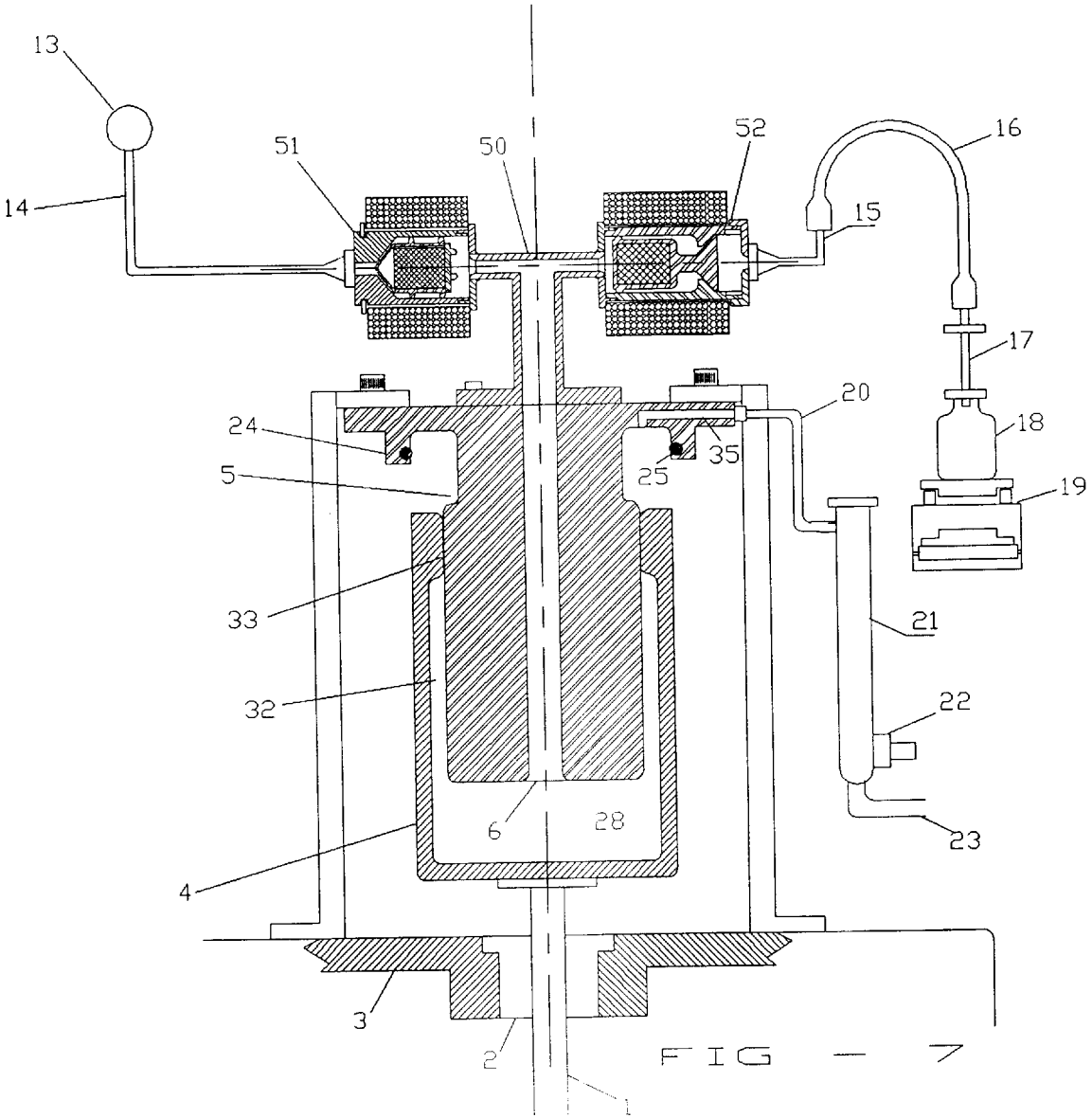
FIG. 7 indicates a sectional view of the same general arrangement of the metering piston pump, but with yet another embodiment of magnetically coupled inlet and discharge valves.
Figure 8B:
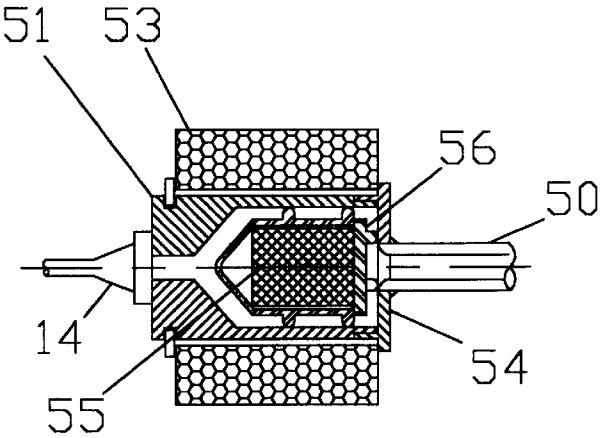
FIG. 8B indicates the same valve as FIG. 8A, but with its valve spool in the open position.
Figure 8C:
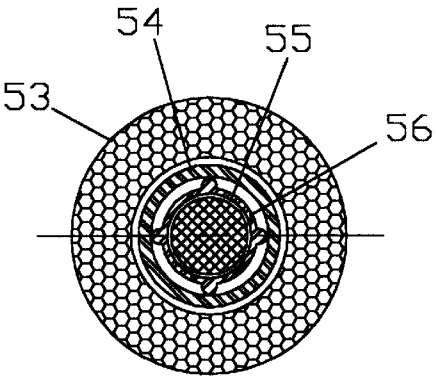
FIG. 8C is a sectional view across section I—I of FIG. 8A.
Figure 8A:
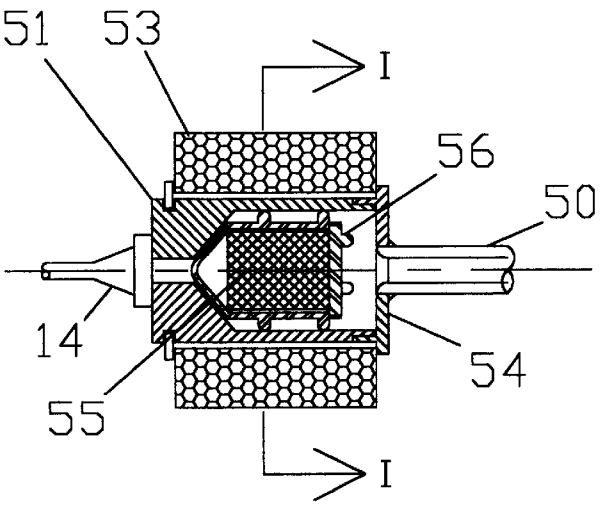
FIG. 8A is an enlarged sectional view of the magnetically coupled inlet valve indicated in FIG. 7. It indicates the valve spool in the closed position.

Another preferred embodiment of the externally mounted, externally actuated poppet valve is indicated in the attached drawings FIG. 7, FIG. 8A and FIG. 8B, in which the valve has one inlet and one discharge port and operates as an ON-OFF (open and close) valve and can serve as either an inlet valve or a discharge valve;

in which the liquid flow is shut off by the tapered poppet located at one end of the spool and in which small nipples around periphery of the spool serve to guide the spool with the valve body cavity;

in which small nipples at the discharge end of the spool serve to limit the travel of the spool to its open position;

in which the spool is magnetically coupled to a coil mounted over the valve body and there is no other device used to couple to and operate the valve spool, and hence no openings for this purpose within the valve body which needs to be sealed during operation and exposed during cleaning and sterilization;

in which a core of magnetic material can be inserted into the spool in those instances where the spool itself is made of a non-magnetic material;

and in which there is no special positioning requirement for the valve spool for cleaning and decontamination since the flow pressure of the cleaning agents and steam exposes all of the liquid product contact parts with the coil de-energized.

Figure 9B:
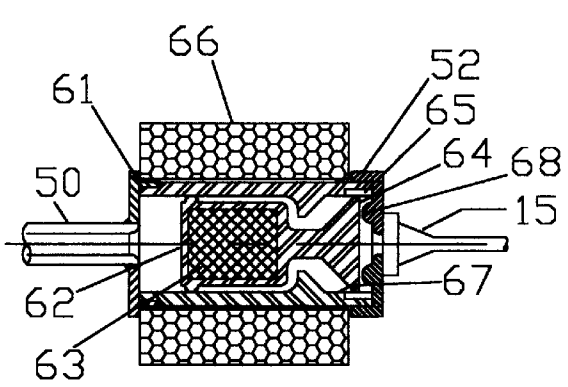
FIG. 9B indicates the same discharge valve indicated in FIG. 9A, but with its valve spool in the open position.
Figure 9C:
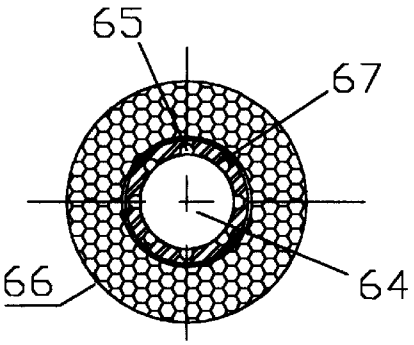
FIG. 9C is a sectional view across section I—I of FIG. 9A.
Figure 9A:
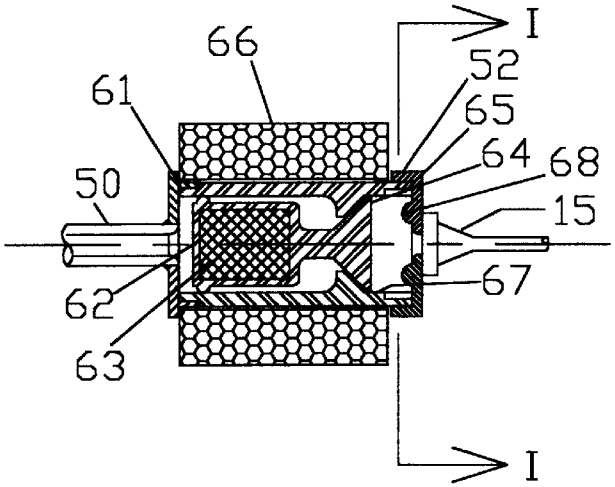
FIG. 9A is an enlarged sectional view of the magnetically coupled discharge valve indicated in FIG. 7. It indicates the valve spool in its closed position.

A final preferred embodiment of the externally mounted externally actuated poppet valve is indicated in the attached drawings FIG. 7, FIG. 9A and FIG. 9B, in which the poppet itself at the discharge end of the valve spool acts as a piston within a cylinder which permits flow of liquid past it through the multiple channels in the wall of the cylindrical cavity, but also serves to act as a close fitting piston within the cylinder, stopping liquid flow and indeed pulling back a certain amount of liquid from the discharge tube and nozzle (suck back), from the point at which the multiple channels in the cylinder wall end;

in which the flow pressure of the cleaning agents and steam once again serves to expose all of the liquid product contact parts for cleaning and sterilization, with the coil de-energized;

in which a coil mounted over the valve body provides the magnetic coupling and forces necessary to shuttle the valve spool and there are no other devices necessary to couple with and operate the spool and hence there is less complexity due to the absence of an opening in the valve body with its consequent sealing and cleaning requirements;

and in which a suitable magnetic core can be provided within the spool in those cases where the spool is made from a non-magnetic material.

FIG. 1 indicates the piston pump and one embodiment of the valves described in this specification. The normal operating (liquid metering and dispensing) mode of the device is indicated.

Item 1 in the drawing is a connecting rod, that connects the cylinder 4 to the reciprocating actuation device which is located under the machine frame 3. (Actuation device not shown). The rod 1 is guided via a sealed linear bearing 2. The piston 5 has a hollow cylindrical port 6 up its axis. Integral with the piston 5, in its upper section is a seal ring 24 equipped with an 'O' ring 25. This section 24 also has a port 35 machined into it. The seal/guide area of the pump is indicated at 33, and has no elastomeric seals. The liquid displaced by reciprocating displacement of the cylinder is the annular volume 32 plus the displaced cavity 28.

Mounted directly on top of the piston 5 and affixed to it, is a valve block 7, which in turn is affixed to the machine frame 27. This valve block 7 has two valve ports shaped into it along with a liquid inlet port 36 and a liquid discharge port 37. Two poppet valves 8 and 9 operate within the two cavities in the valve block 7. The figure shows the inlet valve 8 in the closed position, and the discharge valve 9 in the open position. The two valve spools 8 and 9 are operated by independent actuators (electrical or pneumatic) 10 and 11, which in turn are affixed to the machine frame 27. The liquid product inlet port 36 is connected to the product supply manifold 13 via an inlet tube 14. The liquid product discharge port 37 is connected to the liquid filling nozzle 17 via a rigid tube 15 and a flexible tube 16. The containers to be filled 18, are located on a conveyor 19.

Machined into the seal ring 24 towards the top of the piston 5, is a port 35 connected through a tube 20 to a tubular vessel 21. This vessel 21 is equipped with a temperature measuring device 22 and a discharge port 23.

During liquid pumping operation, the cylinder 4 is reciprocated vertically. In its downward stroke, the volume within the cylinder cavity 28 and 32 expand. The inlet valve spool 8 is opened at the start of the downward stroke of the cylinder, and the liquid product is drawn into the displaced cavity 28 and 32, via the piston port 6. The inlet valve 8 is closed on the start of the upward stroke of the cylinder, which causes the displaced volume within the cylinder 28 and 32 to diminish. The discharge valve 9 is simultaneously opened and the displaced liquid is discharged through this valve 9, through nozzle 17 and into the container 18. Since the valves 8 and 9 are operated independently, a slight delay in closing the discharge valve 9 so that it is a few degrees past the top dead center position of the cylinder 4, will cause the liquid in the discharge tubes 15 and 16 as well as in the discharge nozzle 17 to be sucked back due to the downward motion of the cylinder 4. This 'suck back' feature is extremely useful in maintaining metering accuracy and preventing dripping of the liquid from the tip of the nozzle 17, particularly with products of high visco-elasticity.

Figure 2:
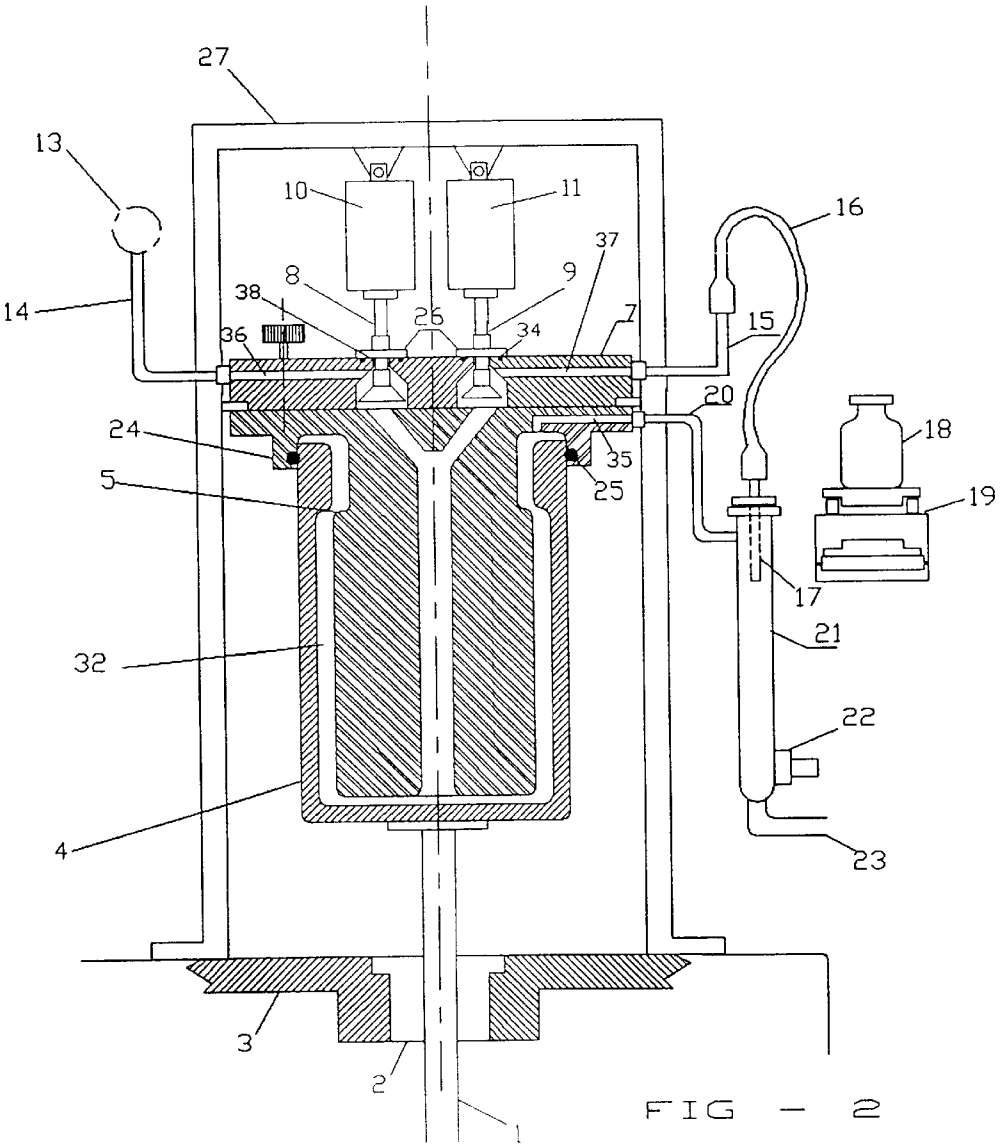
FIG. 2 indicates the same arrangement, except that it is now set up in its cleaning and sterilization mode. Sterilizing is via clean steam.

FIG. 2 indicates the same exact device indicated in FIG. 1, but with elements positioned in the cleaning and sterilization mode.

Cylinder 4 is moved up by connecting rod 1 so that it seats against the seal ring 24. The 'O' ring 25 seats against the outside of the cylinder 4 and ensures a gas and water tight seal. The seal/guide area 33 indicated in FIG. 1, is now exposed to cleaning agents and steam. The two valve actuators 10 and 11 push the valve spools 8 and 9 down so that their seal plates 26 seat against the upper surface of the valve block 7. Here again, elastomeric 'O' rings 34 ensure a gas and water tight seal. The seal/guide area of the poppet valves 38 (which has no elastomeric seal), is thereby exposed to cleaning agents and steam. At the same time, the nozzle 17 is removed manually from its container filling position indicated in FIG. 1, and inserted and affixed to the top of the tubular vessel 21.

Cleaning solution, water and steam can now be run successively through the system. They are supplied via the liquid product manifold 13, and freely circulate through the valve block 7 and the piston/cylinder cavity 32. They are discharged via tubes 15 and 20 into the tubular vessel 21. Affixing of the nozzle 17 to the vessel 21 in the manner indicated, ensures cleaning and sterilization of both internal as well as external surfaces of the nozzle. Cleaning solutions and steam, flow past the temperature sensor 22 which controls the cleaning and sterilization cycle, and discharged from the vessel via port 23.

FIG. 3 is an enlarged view of the valve block 7 indicated in FIG. 2, affixed to the top of the piston 5. The valve spools 8 and 9 as well as well as the cylinder 4 are both in their cleaning and sterilization positions. Open access to cleaning agents and steam, of the seal/guide area 38 of the valve spools 8 and 9 is indicated.

Figure 4A:
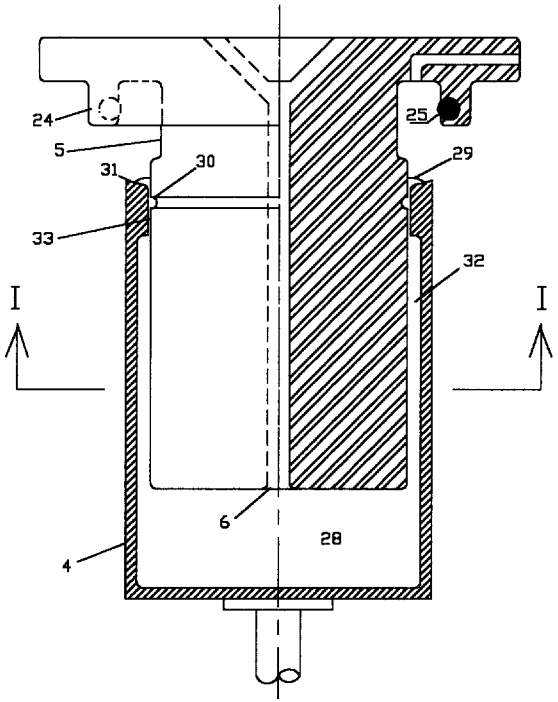
FIG. 4A indicates a sectional view of the piston and cylinder of the pump and highlights the hydrodynamic sealing groove and liquid miniscus.

FIG. 4A indicates an enlarged view of the cylinder 4 and piston 5 indicated previously in FIG. 1. It also indicates a sectional view II, in which the cylindrical port 6 through the center of piston 5 as well as the annular space 32 between the walls of the cylinder 4 and piston 5 are indicated.

The upper surface 31 of the cylinder 4, is sloped downwards towards the center line of the piston 5. There is a small clearance indicated between the seal/guide area 33 between cylinder 4 and piston 5, in which the liquid product forms a lubricating film. Any excess liquid flow past the seal/guide area 33 is retained as a circular pool 29 on the sloped upper surface 31 of cylinder 4. Gravity as well as suction pressure, ensures reintroduction of the liquid pool 29 directly back into the liquid product stream.

A second embodiment to enhance pumping, sealing and lubrication with certain hard to handle liquids, is also indicated with the inclusion of a groove 30 machined onto the outside surface of piston 5. This groove 30 fills with liquid when the cylinder nears to top of its stroke, and serves to provide it back as a film in the seal/guide area 33 of cylinder 4 during its downward stroke.

FIG. 5 indicates the same piston and cylinder arrangement indicated in FIG. 1 and FIG. 2, but with a different embodiment of the poppet valve. The port 6 within the piston is also no longer bifurcated at the top. A flanged tube 41 is affixed to the top of the piston 5 and connects to the valve body 40 at its other end.

Liquid product enters the valve 40 through the inlet tube 14, then in and out through cavity 28 within the pump via port 6, and out again through the valve via discharge tube 15 and into the container 18.

FIG. 6A is an enlarged view of the embodiment of the poppet valve indicated in FIG. 5. It also indicates a sectional view (FIG. 6B) through the valve.

The cylindrical valve body 40 is connected to the inlet tube 14 at the bottom and discharge tube 15 at the top. Within the valve body 40 is a single double ended valve spool 43 with tapered poppets at each end that shuttles up and down alternately opening and closing the inlet and outlet ports. Small nipples 45 around the periphery of the spool 43 serve to guide the spool 43 within the valve body 40. An electro-magnetic coil 42 affixed to the outside of the valve body 40, is utilized to set up the magnetic fields which shuttle the spool 43 within the body 40. In those cases where the valve spool 43 is made of a non magnetic material, a ferrite or other suitable magnetic material 46 is encased within the spool 43; to provide the necessary magnetic coupling between the coil 42 and the spool 43.

Cleaning decontamination and sterilization of valve 40 using cleaning solutions and steam is done without dismantling valve 40 and with coil 42 de-energized. Cleaning solution and steam enter through tube 14 and its pressure serves to lift spool 43 off its seat. The fluid pressure and flow rate of the cleaning solutions and steam is regulated so that it does not overcome the weight of the spool 43 and drive it up into its sent at discharge tube 15. All of the liquid contact parts are thereby exposed to the cleaning agents and steam.

FIG. 7 also indicates the same cylinder and pump assembly as that indicated in FIG. 1 but with yet additional embodiments of the poppet valves. Here again, the central port 6 through the piston 5 is not bifurcated at the top. Also, the top of the piston 5 is affixed to the machine frame.

Poppet valve 51 is one embodiment. It is an ON-OFF valve connected to the inlet tube 14 and to a transfer tube 50 at its other end. Though valve 51 is shown connected to the liquid supply side of the pump, it can also be used for the discharge side. Poppet valve 52 is yet another embodiment and shown connected to the transfer tube 50 at its inlet end and the discharge tube 15 at its outlet. The transfer tube 50 is affixed to the top of piston 5 and in line with its transfer port 6.

Liquid product supplied from manifold 13 is fed into the valve 51, into the transfer tube 50 and down through the piston central port 6 into the cylinder cavity 28 during the downward stroke of the cylinder 4. During the upward stroke of the cylinder 4, the liquid within cavity 28 and 32 is displaced by the piston 5, causing the liquid to flow through port 6 and into transfer tube 50, from where it is directed through valve 52 into the discharge tube 15 and thence to container 18.

FIG. 8A and FIG. 8B are enlarged views of valves 51 and 52 indicated in FIG. 7. The valve 51 is indicated in its closed position in FIG. 8A and in its open position in FIG. 8B. Also indicated is a cross sectional view through II of valve 51 (FIG. 8C). The body of the valve 51 has a hollow shaped cavity within which the spool 56 shuttles. When the spool 56 is in its closed position (FIG. 8A) the flow of liquid through the valve 51, either entering through inlet tube 14 or through discharge tube 50, is shut off. Liquid flow through the valve 51 in its open position (FIG. 8B), is through inlet tube 14 and discharged through transfer tube 50. Small nipples located around the periphery and discharge end of the valve spool 56 serve to guide the spool within the valve body cavity and also limit its stroke.

Around the periphery of valve 51 is an electromagnetic coil 53 which is switched to shuttle the spool 56 via magnetic coupling. In those cases where the spool 56 is made from a non magnetic material (ceramic or certain grades of stainless steel etc.), a ferrite or suitable magnetic material is inserted into the spool 56 and forms its core 55.

No special spool positioning is required during the cleaning and sterilization cycle which is done with coil 53 de-energized. The cleaning solutions and steam enter through tube 14 and its pressure moves the spool to its open position where all of the liquid product contact surfaces are now accessible.

FIG. 9A and FIG. 9B are enlarged view of the valves 51 and 52 indicated in FIG. 7. Valve 52 is shown in its closed or OFF position in FIG. 9A and in its open or ON position in FIG. 9B. Also indicated is a sectional view of the valve through II.

In its closed position (FIG. 9A), liquid flow through valve 51 is shut of in both directions, while in its open position (FIG. 9B), liquid enters through the transfer tube 50 and flows out through the discharge tube 15. The body of valve 52 has a specially contoured cavity as indicated in which the spool 62 shuttles back and forth to open and close the valve. An electromagnetic coil 66 around valve 52 provides the magnetic force to move spool 63 within the valve cavity. Here also, if the spool 62 is made of a non magnetic material, a magnetic core 63 is provided.

At the right side of the spool 62 is a circular tapered poppet 64, which slides within the cylindrical cavity 67 when the spool 62 shuttles from the open to the closed position. Along the periphery of this cylindrical cavity 67, a multiple of small channels 65 extend to a depth of between 50% and 80% of the total depth of cavity 67.

When spool 62 is in its open position (FIG. 9B), liquid flows from transfer tube 50, through the annular space between the valve spool 62 and the cavity within the valve body 52, through the multiple channels 67 past the rim of the poppet 64 and then through discharge tube 15. When the spool 62 is however shuttled towards its closed position, indicated in FIG. 9A, the poppet 64 slides towards its left, past the end of the multiple channels 67. At that point, liquid transfer through valve 52 ceases. Further movement of spool 62 towards its left, causes the poppet 64 to slide like a close fitting piston within the cylinder 67, till it reaches the end of its movement where its tapered face seats against a corresponding face within the cavity of valve 52. This causes a certain amount of liquid present in the discharge tube 15 to be sucked back into the valve. This minimizes liquid dripping from the end of the nozzle and enhances metering precision, particularly with high visco-elastic liquids.

No special spool positioning is required during the cleaning and sterilization cycle which is done with coil 66 de-energized. The cleaning solutions and steam enter through tube 50 and its pressure moves the spool to its open position where all of the liquid product contact surfaces are now accessible.

I claim:

1. A pump of an expansible chamber type and having a moving cylinder being capable of being cleaned with one of a cleaning and a sterilizing fluid without disassembly, said pump comprising:

a housing;

a static piston attached to a valve block, said valve block being statically and firmly attached to an interior wall of the housing, said piston having a lower section of a wide diameter and an upper section of a narrow diameter, said piston including an internal axial channel connecting a bottom and a top of the piston, and further including a port that connects a cavity of the housing to a tube external to the housing, said tube being connected to a wall of said housing;

a reciprocating cylinder, said cylinder being attached to, and reciprocated by a shaft that extends through a wall of said housing, said cylinder having a lower section of a wide internal diameter and an upper section of a narrow internal diameter;

said valve block having an inlet channel and an outlet channel, said channels communicating with an exterior wall of the housing, and having connections to tubes for performing ingress and egress of a pumped fluid; each one of said channels being controlled by a valve that is selectively actuated to control a flow of the pumped fluid into and out of the pump;

said pump having a pumping mode, whereby the cylinder reciprocates along the piston, the upper section of the cylinder sealingly contacting the lower section of the piston;

said pump further having one of a cleaning and a sterilizing mode, whereby the upper section of the cylinder faces without contact the upper section of the cylinder, and said valves simultaneously opening the inlet and the outlet of the pump, thereby allowing introduction of either of a cleaning and a sterilizing fluid into the housing and the cylinder through the inlet, and expulsion of said fluid through said outlet and said port from said housing and said pump.

* * * * *